US008216403B2

(12) United States Patent
Shortridge et al.

(10) Patent No.: US 8,216,403 B2
(45) Date of Patent: Jul. 10, 2012

(54) PERCHLORATE-FREE RED SIGNAL FLARE COMPOSITION

(75) Inventors: Robert G. Shortridge, Bloomington, IN (US); Christina M. Yamamoto, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 20 days.

(21) Appl. No.: 13/007,200

(22) Filed: Jan. 14, 2011

(65) Prior Publication Data

US 2011/0132506 A1 Jun. 9, 2011

Related U.S. Application Data

(62) Division of application No. 12/334,103, filed on Dec. 12, 2008.

(60) Provisional application No. 61/075,647, filed on Jun. 25, 2008.

(51) Int. Cl.
*D03D 23/00* (2006.01)
*C06B 33/00* (2006.01)

(52) U.S. Cl. ..... 149/109.6; 149/19.92; 149/37; 149/61

(58) Field of Classification Search ..... 149/19.92, 149/109.6, 37, 61
See application file for complete search history.

(56) References Cited

U.S. PATENT DOCUMENTS

| | | | | |
|---|---|---|---|---|
| 3,411,964 | A * | 11/1968 | Douda | 149/19.2 |
| 3,499,385 | A | 3/1970 | Douda | |
| 3,673,013 | A | 6/1972 | Lane et al. | |
| 3,690,972 | A | 9/1972 | Kaye et al. | |
| 3,733,223 | A | 5/1973 | Lohkamp | |
| 3,736,206 | A | 5/1973 | Dinsdale et al. | |
| 3,761,329 | A | 9/1973 | Zilcosky | |
| 3,911,823 | A | 10/1975 | Murray et al. | |
| 3,954,529 | A | 5/1976 | Reed et al. | |
| 3,983,816 | A | 10/1976 | Cornia et al. | |
| 4,078,954 | A | 3/1978 | Bernardy | |
| 4,164,186 | A | 8/1979 | Beatty et al. | |
| 4,184,901 | A | 1/1980 | Tanner, Jr. et al. | |
| 4,204,895 | A | 5/1980 | Webster, III | |
| 4,341,573 | A | 7/1982 | Donoho | |
| 4,768,439 | A | 9/1988 | Singer et al. | |
| 4,812,180 | A | 3/1989 | Sayles | |
| 5,056,435 | A | 10/1991 | Jones et al. | |
| 5,061,409 | A * | 10/1991 | Dillehay | 264/3.3 |
| 5,071,497 | A | 12/1991 | Hassell et al. | |

(Continued)

FOREIGN PATENT DOCUMENTS

DE 1282530 B 11/1968

(Continued)

OTHER PUBLICATIONS

Singh, S. N. et al, "A study on magnesium and sodium nitrate based illumination compositions containing different binders", Chemical Abstracts Service, Columbus, OH, US, Mar. 23, 1998.

(Continued)

*Primary Examiner* — Aileen B Felton
(74) *Attorney, Agent, or Firm* — Christopher A. Monsey

(57) ABSTRACT

Perchlorate-free flare compositions are disclosed which, when burned, produce red smoke and flames. Methods of producing the compositions are also disclosed.

8 Claims, 3 Drawing Sheets

U.S. PATENT DOCUMENTS

| | | | | |
|---|---|---|---|---|
| 5,561,260 | A | 10/1996 | Towning et al. | |
| 5,565,150 | A | 10/1996 | Dillehay et al. | |
| 5,585,594 | A | 12/1996 | Pelham et al. | |
| 5,801,321 | A * | 9/1998 | LaGrange et al. | 102/336 |
| 5,917,146 | A | 6/1999 | Hiskey et al. | |
| 6,092,467 | A | 7/2000 | Brice | |
| 6,174,391 | B1 | 1/2001 | Chen et al. | |
| 6,214,139 | B1 | 4/2001 | Hiskey et al. | |
| 6,263,797 | B1 | 7/2001 | Brice | |
| 6,312,537 | B1 | 11/2001 | Hiskey et al. | |
| 6,312,625 | B1 | 11/2001 | Nielson et al. | |
| 6,315,847 | B1 | 11/2001 | Lee et al. | |
| 6,432,231 | B1 | 8/2002 | Nielson et al. | |
| 6,530,327 | B2 | 3/2003 | Hiskey et al. | |
| 6,599,379 | B2 | 7/2003 | Hiskey et al. | |
| 2002/0148540 | A1 | 10/2002 | Hiskey et al. | |
| 2007/0068610 | A1 | 3/2007 | Nickel | |

FOREIGN PATENT DOCUMENTS

| | | | |
|---|---|---|---|
| DE | 4420106 | A1 | 12/1995 |
| ES | 2067419 | A1 | 3/1995 |
| GB | 1284499 | A1 | 8/1972 |
| GB | 2044748 | | 10/1980 |
| WO | WO 00/44689 | | 8/2000 |

OTHER PUBLICATIONS

Mujumdar, V. A. et al, "Study of Mg-Sr(NO3)2 composition with different additives for IR flares and tracer applications", Chemical Abstracts Service, Columbus, OH, US, 1999.

Wilkin, R. T. et al, "Perchlorate behavior in a municipal lake following fireworks displays", Environmental Science and Technology, American Chemical Society, Easton, PA, US, vol. 41, No. 11, Jun. 1, 2007.

International Search Report and Written Opinion for PCT Application No. PCT/US2009/048588 issued by the International Search Authority on Oct. 29, 2009.

Russell, Michael, The Chemistry of Fireworks, Royal Society of Chemistry, 2000, 132 pgs.

Shortridge et al., Elimination of Perchlorate Oxidizers from Pyrotechnic Flare Compositions, Final Technical Report WP-1280, authorized for public release on or after Apr. 24, 2008, 65 pgs. Crane, Indiana.

Shortridge, Robert, Elimination of Perchlorate Oxidizers From Pyrotechnic Flare Compositions, Weapons Systems and Platforms WP-1280, Nov. 2006, 1 pg., Crane, Indiana.

Webster, et al., Flares Containing Calcium Nitrate as an Oxidizer, U.S. Department of Commerce, National Technical Information Service, May 31, 1976, 40 pgs, Crane, Indiana.

Conkling, John A., Chemistry of Pyrotechnics, Basic Principles and Theory, 1985, Marcel Dekker, Inc., 85 pgs. New York, New York.

Halford, Bethany, Pyrotechnics for the Planet—Chemists Seek Environmentally Friendlier Compounds and Formulations for Fireworks and Flares, Chemical & Engineering News, Jun. 30, 2008, pp. 14-18, vol. 86, No. 26.

Smith, Tom, "Assessing the Risks—Suggestions for a Consistent Semi-Quantified Approach", Journal of Pyrotechnic, Winter 2003, 11 pgs.

Shortridge et al, Elimination of Perchlorate Oxidizers from Pyrotechnic Flare Compositions, ESTCP 07E-WP3-021, Navsea Warfare Centers, Dec. 2007, 1 pg., Crane, Indiana.

Shortridge et al. Development and Testing of Perchlorate-Free Red and Green Pyrotechnic Flare Compositions, Department of Mechanical Engineering, New Jersey Institute of Technology, Newark NJ, Jul. 16, 2006, 10 pgs., Crane, Indiana.

* cited by examiner

PERCHLORATE-FREE RED SIGNAL FLARE COMPOSITION

CROSS-REFERENCE TO RELATED APPLICATIONS

This application is a divisional of U.S. patent application Ser. No. 12/334,103, filed Dec. 12, 2008 which claims the benefit of U.S. Provisional Application No. 61/075,647, filed Jun. 25, 2008, both of which are hereby expressly incorporated by reference.

STATEMENT REGARDING FEDERALLY SPONSORED RESEARCH OR DEVELOPMENT

The invention described herein was made in the performance of official duties by employees of the Department of the Navy and may be manufactured, used, licensed by or for the United States Government for any governmental purpose without payment of any royalties thereon.

BACKGROUND

The present disclosure relates to approaches for reformulating red pyrotechnic compositions so as to eliminate environmentally objectionable perchlorate ingredients while still providing acceptable performance when compared to in-service signal flare devices.

Pyrotechnics are used in a variety of applications. One such application is colored signal flares. Many such pyrotechnic flare compositions include chlorate or perchlorate oxidizers. Residual perchlorates from these devices may be absorbed into groundwater and require remediation.

In the past, the vast majority of red, green and yellow signal flares have used perchlorate ingredients to produce their desired colors. This has contributed to an increase in the total concentration of perchlorate residues at various military and industrial sites, and to generally higher than desired concentration in drinking water supplies. Clearly, any methods that can be used to eliminate the perchlorates and minimize any other chlorine-containing ingredients would be an environmentally noteworthy advance in the state of the art.

The U.S. Army has fielded a red star cluster. The red star cluster includes magnesium powder fuel, strontium nitrate oxidizer, polyvinyl chloride (PVC) color enhancer, and binder. The binder includes Laminac 4116, Lupersol DDM binder, and cobalt naphthenate.

The U.S. Navy has an in-service red flare composition (IS RED 1). IS RED 1 includes Granulation 18 magnesium fuel, potassium perchlorate, strontium nitrate, asphaltum, and binder. The binder including Laminac 4110 epoxy and Lupersol DDM curing agent. Accordingly, it was these and other perchlorate-free compositions that formed the starting point in the new perchlorate-free red signal flare formulations disclosed in the present patent application.

SUMMARY

The present disclosure includes a flare composition for producing a red flame, the composition comprising, by weight, a magnesium fuel within the range of approximately twenty-two percent (22%) to approximately thirty-eight percent (38%) of the composition, the magnesium fuel including particles sizes selected from the group consisting of granulation 15, granulation 17, granulation 18, and mixtures thereof, a strontium nitrate oxidizer within the range of approximately forty percent (40%) to approximately sixty percent (60%) of the composition, a polyvinyl chloride color enhancer within the range of approximately eleven percent (11%) to approximately sixteen percent (16%) of the composition, and a two-part curable binder system within the range of approximately four percent (4%) to approximately seven point five percent (7.5%) of the composition, the binder system within the range of approximately seventy percent (70%) to approximately eighty percent (80%) epoxy and within the range of approximately twenty percent (20%) to approximately thirty percent (30%) curing agent.

The present disclosure also includes a method of producing a flare composition, the method comprising the steps of: mixing magnesium within the range of approximately twenty-two percent (22%) to approximately thirty-eight percent (38%) of the composition and a two-part curable binder system within the range of approximately four weight percent (4%) to approximately seven point five weight percent (7.5%) of the composition, wherein magnesium includes particles sizes selected from the group consisting of granulation 15, granulation 17, granulation 18, and mixtures thereof, wherein the binder system includes within the range of approximately seventy percent (70%) to approximately eighty percent (80%) epoxy and within the range of approximately twenty percent (20%) to approximately thirty percent (30%) curing agent, blending strontium nitrate within the range of approximately forty weight percent (40%) to approximately sixty weight percent (60%) of the composition, and polyvinyl chloride within the range of approximately eleven weight percent (11%) to approximately sixteen weight percent (16%) of the composition, mixing the strontium nitrate and polyvinyl chloride mixture to the binder system coated magnesium mixture in a mixing bowl to provide the composition, and wiping the sides of the mixing bowl, screening the composition, aging the composition for a period of time, and pressing the composition into the flare composition.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
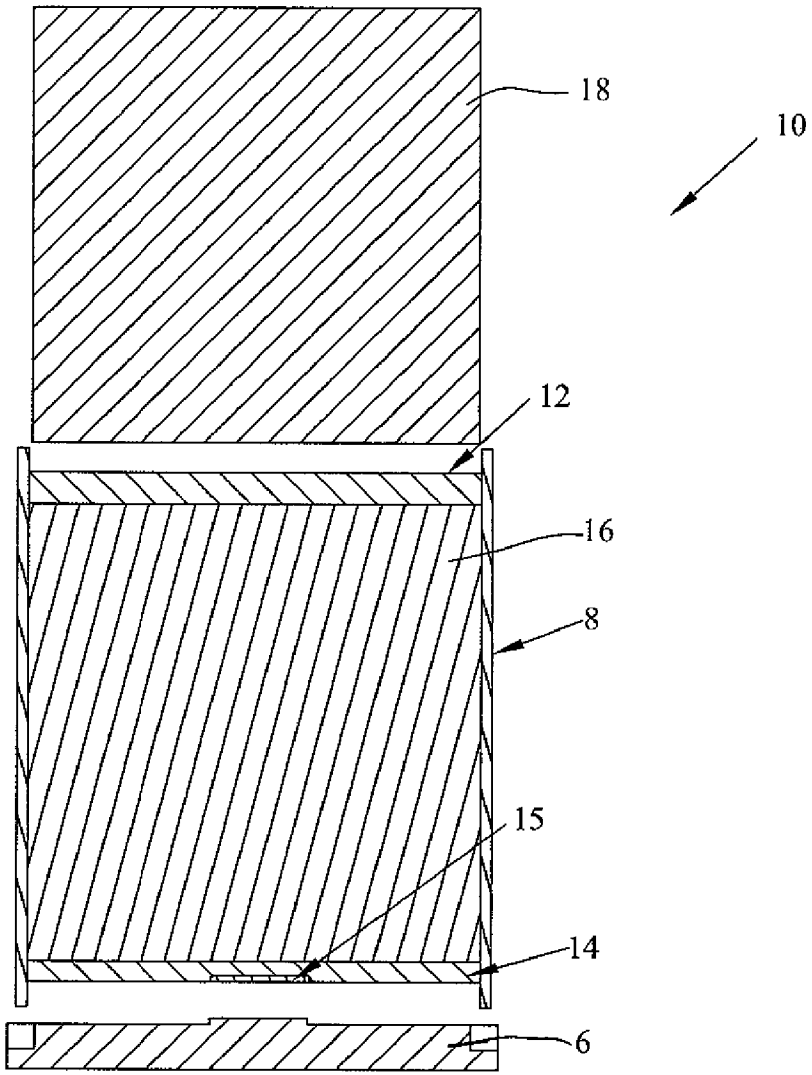
FIG. 1 is a schematic illustration of an illustrative embodiment of a signal flare in an inverted orientation for pressing by a ram.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE EXEMPLARY EMBODIMENTS

The embodiments disclosed below are not intended to be exhaustive or limit the invention to the precise forms disclosed in the following detailed description. Rather, the embodiments are chosen and described so that others skilled in the art may utilize their teachings.

In the present disclosure, perchlorate oxidizers currently used in various in-service flare compositions are substituted with nitrate or other less energetic oxidizers. Because these oxidizers are less reactive than those that include perchlorate, higher-energy fuels are used to make up for the loss in energy.

Specifically, compositions and methods are disclosed in which perchlorate-free pyrotechnic compositions are prepared for use either as linear burning, 0.75-inch diameter, free-standing laboratory scale red signal flare candles, or as 1.2-inch diameter linear burning prototype scale red flare candles pressed into fish paper tubes 8 (FIG. 1). It is intended that these perchlorate-free flare candles be prepared in such a way to produce either equal or superior luminous intensities, burn times, dominant wavelengths, and color purities when compared with the in-service perchlorate-containing compositions.

Perchlorate-free compositions of the present disclosure, generally referred to as RSF-4, comprise varying size granulations of magnesium fuel, nitrate oxidizers, a chlorine donor, and binder. The compositions may be initially pressed into laboratory scale pellets in order to fine tune the burn rates and luminous intensity output. Compositions are then scaled to the above mentioned concept scale red candles, such as the 1.2-inch diameter linear burning prototype scale red flare candles pressed into fish paper tubes 8 (FIG. 1).

As shown in FIG. 1, flare candle 10 includes a bottom layer of approximately 3 to approximately 5 grams of inert fireclay composition 12, and a top layer of approximately 2.5 grams of ignition composition 14, on top of which ignition slurry 15 is painted in order to aid in ignition transfer. Typically inert fireclay composition 12 is a separate composition for safety purposes and for thermal insulation to prevent flare candle 10 from igniting any smoke portion created during operation of flare candle 10. Ignition composition 14 is added as a top layer to assist in ignition of flare candle 10.

As discussed in greater detail below, flare candle 10 also includes perchlorate-free pyrotechnic composition 16. To enhance the safety of the pellet pressing operation, candle 10 is pressed in an upside down orientation so that moving upper ram 18 comes in direct contact only with the inert fireclay composition layer 12 and that base of press 6 comes in to contact with ignition composition 14. Pressed candles 10 are then subjected to performance testing in a photometric tunnel. Candles 10 are illustratively tested in an upside down orientation with an approximately 12-14 mph airflow in order to aid in smoke removal.

Perchlorate-free red flare compositions of the present disclosure (RSF-4) have been formulated in the 24-gram form factor red flare used in the Navy's red signal flare (IS Red 2) and are subjected to similar performance testing. The 24-gram form factor does not include the inert fireclay and ignition compositions mentioned above. IS RED 2 weighs within the range of approximately twenty-three grams (23 g) to approximately twenty-six point five grams (26.5 g). IS RED 2 includes approximately twenty-four point four percent (24.4%) Granulation 15 (referred to as GR 15) magnesium fuel, approximately twenty point five percent (20.5%) potassium perchlorate, approximately thirty-four point seven percent (34.7%) strontium nitrate, PVC, and approximately nine percent (9%) asphaltum as a non-curable binder.

The perchlorate-free red flare compositions of the present disclosure may not include either the hygroscopic calcium nitrate or the environmentally objectionable potassium perchlorate ingredients. Rather these compositions may include varying percentages of magnesium fuel, strontium nitrate oxidizer, polyvinyl chloride color enhancer, and a 2-part curable binder system including Epon™ Resin 813 epoxy and Versamid® 140 curing agent. Epon™ Resin 813 is a low viscosity liquid bisphenol-A based epoxy resin diluted with cresyl glycidyl ether. Epon™ Resin 813 is available through Hexion Speciality Chemicals of Houston, Tex. (www.hexion.com). Versamid® 140 is a medium low viscosity reactive polyamide resin based on dimerized fatty acid and polyamindes. Versamid® 140 is available through Cognis of Cincinnati, Ohio (www.cognis.com).

More specifically, the perchlorate-free red flare compositions of the present disclosure may include from approximately twenty-two percent (22%) to approximately thirty-eight percent (38%) of magnesium fuel which may be comprised of varying percentages of Granulation 18 (sometimes referred to as GR 18), Granulation 17 (similarly referred to as GR 17) and GR 15 magnesium. Materials including magnesium are known to take several forms, such as powder, atomized, and amorphous flakes. In one embodiment of the present disclosure, the magnesium source is atomized.

In Table 1, granulation numbers 15, 17, and 18, among others, are described in greater detail. In Table 2, granulation requirements for granulation numbers 15, 17, and 18, among others, are described in greater detail. Tables 1 and 2 are from the American Society for Testing and Materials document MIL-DTL-382D, the subject matter of which is expressly incorporated by reference.

TABLE 1

American Society for Testing and Materials (ASTM) Granulation Numbers

| Granulation Number | Nominal Mesh Size | |
|---|---|---|
| | Metric | U.S. |
| 1 | 425 μm-180 μm | 40-80 |
| 2 | 425 μm-180 μm | 40-80 (alternate) |
| 3 | 300 μm-150 μm | 50-100 |
| 4 | 300 μm-150 μm | 50-100 (Army) |
| 5 | 300 μm-125 μm | 50-120 |
| 6 | 180 μm-125 μm | 80-120 |
| 7 | 150 μm | 100 |
| 8 | 125 μm-75 μm | 120-200 |
| 9 | 106 μm | 140 |
| 10 | 75 μm | 200 |
| 11 | 180 μm-75 μm | 80-200 |
| 12 | 125 μm-75 μm | 120-200 (Army) |
| 13 | 850 μm-300 μm | 20-50 |
| 14 | 300 μm-150 μm | 50-100 |
| 15 | 150 μm-75 μm | 100-200 |
| 16 | 75 μm-45 μm | 200-325 |
| 17 | 300 μm-150 μm | 50-100 |
| 18 | 600 μm-300 μm | 30-50 |

TABLE 2

American Society for Testing and Materials (ASTM) Granulation requirements[1].

| Granulation | Max Sieve Metric (U.S.) | Percent Pass | Min Sieve Metric (U.S.) | Percent Pass | Density[2] (gm/ml) Max | Density[2] (gm/ml) Min |
|---|---|---|---|---|---|---|
| 1 | 600 μm (No. 30) | 100% | 180 μm (No. 80) | 15% | 0.65 | 0.55 |
| 2 | 300 μm (No. 50) | 90% | 180 μm (No. 80) | 5% | 0.65 | 0.55 |
| 3 | 600 μm (No. 30) | 10% | 150 μm (No. 100) | 15% | 0.75 | 0.65 |
| 4 | 850 μm (No. 20) | 100% | 150 μm (No. 100) | 12% | 0.625 | 0.45 |
| 5 | 425 μm (No. 40) | 100% | 125 μm (No. 120) | 10% | — | — |
| 6 | 212 μm (No. 70) | 100% | 125 μm (No. 120) | 10% | — | — |
| 7 | 150 μm (No. 100) | 98% | — | — | — | — |
| 8 | 250 μm (No. 60) | 100% | 75 μm (No. 200) | 10% | — | — |
| 9 | 125 μm (No. 120) | 98% | 75 μm (No. 200) | 0% | — | — |
| 10 | 125 μm (No. 120) | 100% | 75 μm (No. 200) | 90-100% | — | — |
| 11 | 710 μm (No. 25) | 100% | 75 μm (No. 200) | 25% | — | — |
| 12 | 150 μm (No. 100) | 100% | 75 μm (No. 200) | 85% | — | 0.45 |
| 13 | 3.35 mm (No. 6) | 100% | 300 μm (No. 50) | 5% | — | 0.45 |
| 14 | 300 μm (No. 50) | 90% | 150 μm (No. 100) | 15% | — | 0.70 |
| 15 | 300 μm (No. 50) | 100% | 75 μm (No. 200) | 15% | 0.75 | 0.65 |
| 16 | 75 μm (No. 200) | 96% | 4 μm (—) | 0% | — | 0.62 |
| 17 | 600 μm (No. 30) | 100% | 150 μm (No. 100) | 15% | — | 0.90 |
| 18 | 1.18 mm (No. 16) | 99% | 212 μm (No. 70) | 1% | — | 0.90 |

[1]All percentages shall be by weight using sieves conforming to ASTM E 11, "Standard Specification for Wire-Cloth Sieves for Testing Purposes." The powder shall pass through the required sieves readily without balling or the particles clinging together.
[2]Density of the magnesium powder is determined in accordance with ASTM B 329, "Standard Test Method for Apparent Density of Refractory Metals and Compounds by the Scott Volumeter."

MIL-DTL-382D describes the process for measuring the granulation units described in Tables 1 and 2. Specifically, MIL-DTL-382D states to place a weighed portion of approximately 50 g of the sample on the top sieve of a nest of sieves assembled as specified in Table 2 and provide with a bottom pan. Cover and shake for 30 minutes in a mechanical shaker geared to produce 300±15 gyrations and 150±10 taps of the striker per minute. Weigh the portions retained by each sieve and calculate to a percentage as required.

The perchlorate-free red flare compositions of the present disclosure may include from approximately forty percent (40%) to approximately sixty percent (60%) of strontium nitrate oxidizer, from approximately eleven percent (11%) to approximately sixteen percent (16%) of polyvinyl chloride (PVC) color enhancer, and from approximately four percent (4%) to approximately seven point five percent (7.5%) of a two-part curable binder system which includes the range of approximately seventy percent (70%) to approximately eighty percent (80%) of Epon™ Resin 813 epoxy and within the range of approximately twenty percent (20%) to approximately thirty percent (30%) of Versamid® 140 curing agent. These compositions may be originally studied at laboratory scale, and are then scaled to the same 24-gram IS Red 2 red flare form factor. These compositions are then subjected to flare performance testing. Ignition sensitivity testing is done at each scale.

Figure 2:
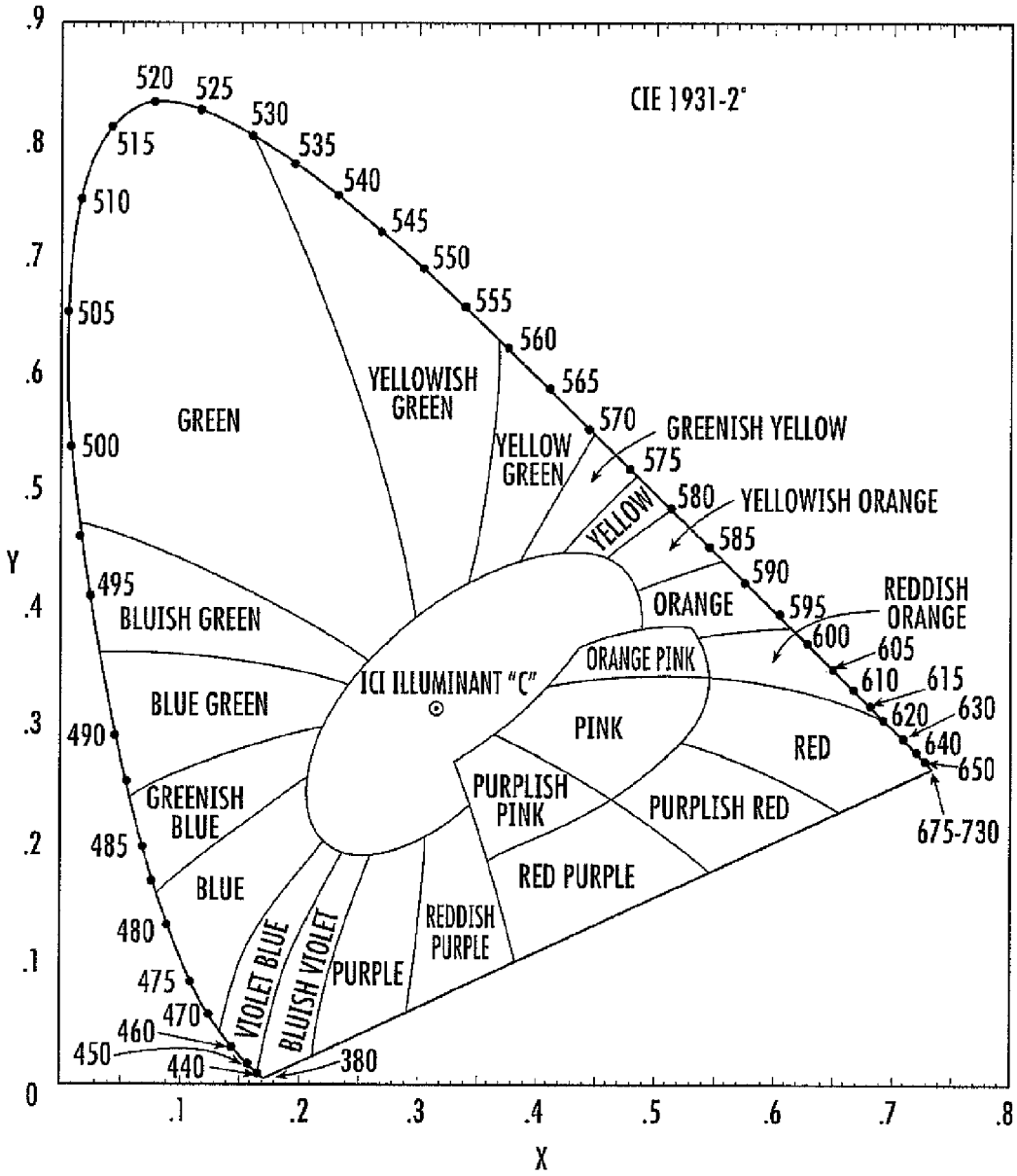
FIG. 2 is a representation of a Chromaticity Diagram.

During these tests, the luminous intensities are measured with a candlepower meter (also known as candelas (cd)), and a Tri-Stimulus colorimeter may be used to obtain X-bar, Y-bar and Z-bar color coordinates from which the dominant wavelength and the color purity may be obtained using the well-known Chromaticity Diagram as illustrated in FIG. 2. Each of the three colorimeters in this device is filtered so that it records the emission intensity of the flare versus time in one of three spectral regions in the visible spectrum. The X-bar, Y-bar and Z-bar coordinates are obtained when the ratios of the integrated intensity from each colorimeter is divided by the total intensity from all three colorimeters. The X-bar and Y-bar coordinates are then located on the Chromaticity Diagram and a straight line is drawn through that point and the "white light" point at approximately X-bar=0.310, Y-bar=0.316. The dominant wavelength is found at the point this line intersects with the nearest axis of the Chromaticity Diagram. The color purity is calculated as the percentage corresponding to the fraction that is formed by dividing the distance between the white light point and the measured X,Y point by the distance between the white light point and the intersection of the line with the axis of the Chromaticity Diagram.

In these tests the luminous intensities substantially exceeded those of the in-service perchlorate-containing IS Red 2 red flares that were used as comparison standards. With these higher intensities, the perchlorate-free compositions of the present disclosure beneficially increased the burn time of the red signal flares while still meeting all flare performance specifications for luminous intensity, dominant wavelength and color purity. As shown in Table 4, the in-service flares on average burned in approximately 17.5 seconds. Specifically, the perchlorate-free compositions of the present disclosure increased the burn time from the low end of the 16-23 seconds range specified in the performance specification to the upper end of the range in the 20-21 second region. For example the 5% binder composition provided a burn time of approximately 16 seconds. As shown in Table 4, the perchlorate-free compositions of the present disclosure including 7% binder composition provided a burn time in the range of approximately 20 to approximately 21 seconds. A longer burning signal such as this should beneficially increase the likelihood that a signal being burned by a downed aviator or a user in distress could be spotted by rescue aircraft.

Tailoring of the burn time of this perchlorate-free red flare is accomplished by changes in the magnesium particle size granulation, variation of the fuel to oxidizer (F/O) ratio of the composition, and variation of the weight percentage of the epoxy binder system. In general, it is observed that the burn time can be lengthened by lowering the fuel to oxidizer ratio, by increasing the particle size granulation of the magnesium fuel, and by increasing the weight percentage of the curable binder system.

Table 3 is included to show representative embodiments of the perchlorate-free RSF-4 type composition. Similarly, Table 4 provides the flare performance test results of representative embodiments of the RSF-4 red flare.

TABLE 3

RSF-4 Type Perchlorate-Free Red Flare Compositions in Percent by Weight

| Description | Mg GR 17 | Mg GR 15 | $Sr(NO_3)_2$ | PVC | Epon 813 | Versamid 140 |
|---|---|---|---|---|---|---|
| 5% Binder | 33 | 0 | 48 | 14 | 3.5 | 1.5 |
| 6% Binder | 32.65 | 0 | 47.5 | 13.85 | 4.2 | 1.8 |
| 6% Binder, Finer Mg | 24.49 | 8.17 | 47.49 | 13.85 | 4.2 | 1.8 |
| 7% Binder, Low F/O | 25 | 0 | 52.645 | 15.355 | 4.9 | 2.1 |
| 7% Binder, Moderate F/O | 28 | 0 | 50.323 | 14.677 | 4.9 | 2.1 |
| 7% Binder, High F/O | 32.305 | 0 | 46.989 | 13.705 | 4.9 | 2.1 |
| 7% Binder Ultra High F/O | 34 | 0 | 45.677 | 13.323 | 4.9 | 2.1 |

TABLE 4

Averaged Performance Test Results and Standard Deviations of Standard IS Red 2 and Perchlorate-Free Prototype Scale RSF-4 Red Signal Flare Compositions.

| Flare Designation | #Averaged | Dominant Wavelength, nanometers (nm) | Color Purity | Luminous Intensity, cd | Burn Time, sec |
|---|---|---|---|---|---|
| IS Red 2 Std | 48 | 617 | 94% | 4913 ± 745 | 17.45 ± 0.64 |
| 5% Binder | 21 | 608 | 92% | 11207 ± 501 | 16.07 ± 0.47 |
| 6% Binder | 38 | 617 | 95% | 9991 ± 854 | 17.38 ± 0.50 |
| 6% Binder, Finer Mg | 21 | 607 | 92% | 11664 ± 518 | 14.89 ± 0.35 |
| 7% Binder, Low F/O[1] | 19 | 614 | 95% | 6410 ± 1749 | 22.13 ± 1.01 |
| 7% Binder, Low F/O[2] | 8 | 613 | 96% | 5413 ± 227 | 22.55 ± 0.40 |
| 7% Binder, Low F/O[3] | 11 | 624 | 96% | 5570 ± 851 | 22.54 ± 0.84 |
| 7% Binder, Moderate F/O[4] | 20 | 614 | 95% | 8064 ± 2933 | 20.07 ± 1.27 |
| 7% Binder, Moderate F/O[5] | 12 | 621 | 96% | 6040 ± 654 | 19.83 ± 0.65 |
| 7% Binder, Moderate F/O[6] | 8 | 617 | 96% | 7222 ± 2306 | 19.35 ± 1.09 |
| 7% Binder, Moderate F/O[7] | 10 | 627 | 95% | 6863 ± 2402 | 21.08 ± 0.32 |
| 7% Binder, Moderate F/O[8] | 10 | 624 | 95% | 7031 ± 1805 | 20.95 ± 1.08 |
| 7% Binder, Moderate F/O[9] | 10 | 627 | 95% | 7008 ± 1742 | 20.37 ± 0.80 |
| 7% Binder, Moderate F/O[10] | 10 | 624 | 95% | 5895 ± 411 | 21.59 ± 0.57 |
| 7% Binder, Moderate F/O[11] | 12 | 643 | 96% | 5903 ± 535 | 18.05 ± 0.40 |
| 7% Binder, High F/O[12] | 9 | 616 | 96% | 7918 ± 2460 | 18.44 ± 0.77 |
| 7% Binder, High F/O[13] | 8 | 616 | 96% | 8607 ± 2839 | 18.55 ± 0.48 |
| 7% Binder, High F/O[14] | 10 | 623 | 95% | 7367 ± 1404 | 18.79 ± 0.70 |
| 7% Binder, High F/O[15] | 11 | 640 | 96% | 8112 ± 1404 | 18.95 ± 0.70 |
| 7% Binder, UltraHighF/O[16] | 10 | 618 | 96% | 9289 ± 3592 | 17.42 ± 0.75 |
| 7% Binder, UltraHighF/O[17] | 9 | 618 | 93% | 9209 ± 3536 | 17.54 ± 0.81 |

[1]L-Pellet Series with 25% by weight of Granulation 17 magnesium

[2]N-1 through N-10 Pellet Series with the usual pressing pressure of eight thousand pounds (8,000 lbs) dead load

[3]N-11 through N-21 Pellet Series with a nine thousand pounds (9,000 lbs) dead load pressing pressure

[4]K-Pellet Series with 28% by weight of Granulation 17 magnesium

[5]H-1 through H-12 Pellet Series with a pressing pressure of eight thousand pounds (8,000 lbs) dead load and 5 seconds dwell time. Dwell time characterized as the amount of time of pressing pressure.

[6]H-13 through H-20 Pellet Series with a pressing pressure of nine thousand pounds (9,000 lbs) dead load and 10 seconds dwell time TABLE 4-continued Averaged Performance Test Results and Standard Deviations of Standard IS Red 2 and Perchlorate-Free Prototype Scale RSF-4 Red Signal Flare Compositions.

| Flare Designation | #Averaged | Dominant Wavelength, nanometers (nm) | Color Purity | Luminous Intensity, cd | Burn Time, sec |
|---|---|---|---|---|---|

[7]O-1 through O-10 Pellet Series in which the usual press consolidation dwell time of 5 seconds is used

[8]O-11 through O-20 Pellet Series in which a dwell time of 10 seconds is used

[9]P-Pellet Series in which a pressing pressure of nine thousand pounds (9,000 lbs) dead load is used in lieu of the eight thousand pounds (8,000 lbs) dead load used for the O-Pellet Series

[10]S-1 through S-10 Pellet Series in which extended ingredient mixing times, sieving of composition, and nine thousand pounds (9,000 lbs) dead load pressing pressure were used

[11]S-11 through S-22 Pellet Series in which the composition for the S-1 through S-10 Series is held overnight before pressing at nine thousand pounds (9,000 lbs) dead load. However, 20.5 grams of flare composition is used instead of the usual 23 grams thus proportionately decreasing the burn time.

[12]J-1 through J-10 Pellet Series with 32.3% by weight of Granulation 17 magnesium, eight thousand pounds (8,000 lbs) dead load and 5 seconds dwell time

[13]J-11 through J-18 Pellet Series with eight thousand pounds (8,000 lbs) dead load and 10 seconds dwell time

[14]R-1 through R-10 Pellet Series with the usual eight thousand pounds (8,000 lbs) dead load pressing pressure

[15]R-11 through R-21 Pellet Series with a nine thousand pounds (9,000 lbs) dead load pressing pressure

[16]I-1 through I-10 Pellet Series with 34% by weight of Granulation 17 magnesium, eight thousand pounds (8,000 lbs) dead load and 5 seconds dwell time

[17]I-11 through I-19 Pellet Series with eight thousand pounds (8,000 lbs) dead load and 10 seconds dwell time An examination of Table 4 reveals a number of useful observations that can be used to identify the desired embodiments of the RSF-4 perchlorate-free red flare for particular applications.

From the trends exhibited in Table 4, the burn time of the flare candle can readily be tailored over a fairly wide range encompassing the 16-23 second range of the IS Red 2 red flare. To be acceptable, the IS RED 2 red flare should have an approximately sixteen to twenty-three second (16-23 sec) burn time, a luminous intensity of thirty-five hundred candela (3500 cds), a minimum dominant wavelength of six hundred nanometers (600 nm), and a minimum color purity of eighty percent (80%).

In one embodiment from the data presented in Table 4, a composition with a moderate fuel/oxidizer ratio including 28 percent by weight of Granulation 17 magnesium and 7% epoxy binder provides a perchlorate-free product improvement over the red flare in the IS Red 2 red signal flare. However, the other embodiments shown in Table 4 may also be useful in other red signal flare devices. Taken as a whole, Table 4 also provides useful information on factors such as batch to batch repeatability of the various embodiments of the RSF-4 red flare, as well as on formulation tolerances applicable to the illustrative embodiment. Table 4 illustrates the effects on flare performance of deviating from the ingredient weight percentages of the illustrative embodiment in either the positive or negative direction.

Table 4 also provides information on the reproducibility of performance parameters such as luminous intensity from one candle to the next in a given batch. It is seen that both the in-service IS Red 2 composition, as well as the perchlorate-free RSF-4 compositions with both 5% and 6% by weight of epoxy binder produced luminous intensities with generally moderate standard deviations. The initially studied RSF-4 compositions with 7% by weight of binder exhibits significantly larger standard deviations of the luminous intensities. Contributing to these high standard deviations are a fairly significant number of flare candles that exhibited irregular luminous intensity versus time burn profiles. Some of these initially studied RSF-4 compositions burn at significantly higher intensity for a proportionately shorter burn time. Others start out at high intensity but then abruptly drop off to a relatively low intensity during the course of the burn. A close examination of the two test series with the S-Pellet Series reveals that the standard deviations of the luminous intensities are once again in the low to moderate range. These flares tended to give much smoother burn profiles (similar to the in-service IS Red 2 red flares) than the other flares with the 7% binder loading.

Figure 3:
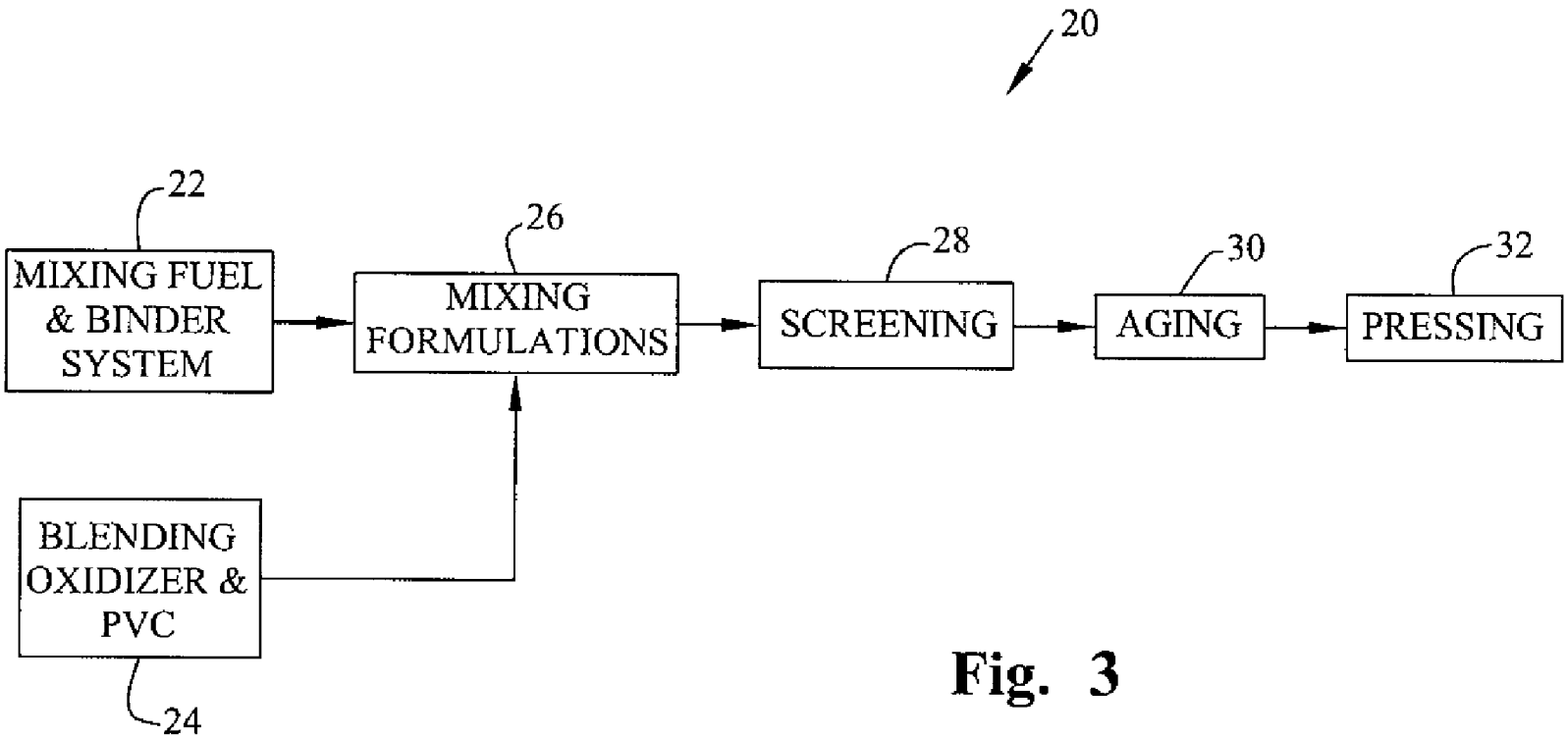
FIG. 3 is a schematic illustration of a flow chart illustrative of preparing the signal flare composition.

As shown in FIG. 3, illustrative manufacturing process 20 includes the step of mixing 22 magnesium with the two-part curable binder system. In one embodiment, the sides of the mixing bowl are wiped with a non-sparking spatula during the course of the mixing process of step 22. For example, magnesium and the two-part curable binder system are mixed for five minutes (5 min). This action may be followed by wiping the sides of the mixing bowl with a non-sparking spatula. The substeps of mixing and wiping may be repeated two (2) to approximately four (4) times.

Manufacturing process 20 also includes the step of blending 24 strontium nitrate and polyvinyl chloride. In one embodiment, strontium nitrate and polyvinyl chloride are placed on either a Standard No. 16 or No. 30 sieve. With a cotton mitt, the ingredients are hand worked through the sieve onto a bottom pan. This action may be repeated approximately three (3) times.

The next step of manufacturing process 20 includes mixing 26 portions of mix 22 with portions of blend 24. In one embodiment, the sides of the mixing bowl are wiped with a non-sparking spatula during the course of the mixing process of step 24. For example, mixture 26 is mixed for five minutes (5 min). This action may be followed by wiping the sides of the mixing bowl with a non-sparking spatula. The substeps of mixing and wiping may be repeated two (2) to approximately four (4) times.

Manufacturing process 20 includes the steps of screening 28 and aging 30 composition 16 for a period of time. Finally, manufacturing process 20 includes the steps of pressing 32 composition 16.

This improved performance results from certain beneficial changes in the manufacturing process:

As illustrated in step 26, composition 16 is mixed for longer periods of time after adding the pre-blended strontium nitrate and polyvinyl chloride ingredients to the binder coated magnesium fuel. In one embodiment, the sides of the mixing bowl are wiped more frequently with a non-sparking spatula during the course of the mixing process of step 26. For example, composition 16 is mixed for five minutes (5 min).

This action may be followed by wiping the sides of the mixing bowl with a non-sparking spatula. The substeps of mixing and wiping may be repeated two (2) to approximately four (4) times. This leads to a more homogeneous mixture and seems to be an illustrative change in terms of improved performance.

As illustrated in step 28 of FIG. 3, composition 16 is screened 28 through a Standard No. 16 sieve after mixing step 26, and prior to press consolidation step 32. In this illustrative embodiment, the sieve serves to remove from mixture 16 any clumps larger than approximately 0.9 millimeter which would be expected to be binder rich and would lead to a less homogeneous mixture if the larger clumps are included.

Composition 16 is allowed to age 30 for at least approximately three to approximately four hours after being mixed 26 and before being press consolidated 32 into flare candles 10. The composition from which the S-11 to S-22 pellets are pressed 32 and allowed to age 30 overnight and are found to be an uncured state and in a readily pressable condition. In one embodiment, the composition is batched in five hundred grams (500 g) units for overnight aging 30. It is likely that this aging step 30 permits any heat and/or gaseous products that are liberated when the two binder components are mixed 26 to be dissipated prior to the press consolidation step.

The press consolidation 32 pressure is increased from approximately eight thousand pounds (8,000 lbs) dead load to approximately nine thousand pounds (9,000 lbs) dead load.

An advantage over the earlier versions of these red signal flares is that composition 16 does not include environmentally objectionable perchlorate ingredients. All of these colored flares give comparable or somewhat improved performance including their general appearance, candlepower luminous intensity, burn time, dominant wavelength, and color purity. This should ensure that these perchlorate-free colored signal flare compositions continue to meet or exceed all of the performance parameters included in the in-service flare performance specifications for the red signal flares.

In the case of the red flares, the increase in the luminous intensity at the 16-17 second burn time of the in-service red flare in the IS Red 2 red signal flare is as high as a factor of two. Therefore, these perchlorate-free colored signal flare compositions are able to beneficially lengthen the burn time toward the longer end of the 16-23 second burn time range given in the flare performance specification while still exceeding the luminous intensity of the in-service IS Red 2 red flare. This should beneficially increase the likelihood that a downed aviator burning one of these red signal flares could be spotted by rescue aircraft in the area.

Another advantage is that elimination of the perchlorate oxidizer from these red compositions is determined not to have significantly increased the ignition sensitivity of these compositions to impact, rotary friction or electrostatic stimuli. This reduces the potential for an accidental initiation of a signal flare. Table 5 is included to compare the measured ignition sensitivities of the in-service and perchlorate-free colored signal flare compositions, as well as to explain the classification criteria used during this sensitivity testing. It is noted that excessively high ignition sensitivity can often be mitigated by substituting coarser fuel particles, as well as by either increasing the binder percentage of the composition, or by carrying out a separate binder pre-coating step of electrostatic and friction sensitive fine particle fuels. Accordingly, it is observed that the friction sensitivity of the RSF-4 composition including 7% of epoxy binder is beneficially improved when compared to the corresponding friction sensitivities of the compositions with 5% and 6% of epoxy binder. It is noted that this strategy is also effective in increasing the burn time of the signal flares.

TABLE 5

Ignition Sensitivities of In-Service and Perchlorate-Free Red Signal Flare Compositions

| | Impact | | | | Electrostatic Sensitivity | |
|---|---|---|---|---|---|---|
| | Sensitivity 50% tire | | Friction Sensitivity | | | Maximum No Fire |
| | Height | Energy | Energy (ft-lb) | | | Energy |
| Sample | (cm) | (J) | Average | Lowest | Response | (Joules |
| IS Red 1 Red Standard | 178.40 | 34.97 | 1655.00 | 916.93 | 10% Fired | 0.250 |
| RSF-4, 7% Binder | 167.00 | 32.73 | 1049.68 | 179.63 | 40% Fired | 0.180 |
| RSF-4, 6% Binder | 167.35 | 32.80 | 242.96 | 55.87 | 90% Fired | 0.151 |
| RSF-4, 5% Binder | 172.98 | 33.90 | 402.21 | 33.24 | 80% Fired | 0.151 |

Classification Criteria

The following table represents the energy levels required to classify a material with respect to its sensitivity to various forms of external energy input.

| | Impact 50% fire | | | |
|---|---|---|---|---|
| Sensitivity Level | height (cm) | energy (Joule) | Friction (Foot-pound) | Electrostatic (Joule) |
| Dangerous | <10 | <1.96 | <30 | <0.01 |
| High | <32 | <6.27 | <100 | <1.0 |
| Moderate | <100 | <19.6 | <500 | <10.0 |
| Low | <159 | <31.16 | <1000 | <25.0 |
| Very Low | <50% fires at 159 cm/31.16 Joule | | >1000 | >25.0 |
| Non-reactive | No energetic reactions observed at upper limit of apparatus being used. | | | |

Some alternatives in the composition of the present disclosure has been alluded to above and should be obvious to one skilled in the art. For example, the ingredient percentages may be modified in order to tailor the burn rate and cause the signal flares to burn for a longer or shorter time. The percentage and the particle size granulation of metallic fuels may also be modified in order to make the composition more or less sensitive to accidental initiation by impact, rotary friction, or electrostatic stimuli, as well as to tailor its burn rate. The choice of the binder system as well as its weight percentage in the composition is also known by one skilled in the art to affect both the ignition sensitivity and the burn rate of the signal flare compositions.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of producing a flare composition, the method comprising the steps of:

mixing magnesium within the range of approximately twenty-two percent (22%) to approximately thirty-eight percent (38%) of the composition and a two-part curable binder system within the range of approximately four weight percent (4%) to approximately seven point five weight percent (7.5%) of the composition, wherein magnesium includes particles sizes selected from the group consisting of granulation 15, granulation 17, granulation 18, and mixtures thereof, wherein the binder system includes within the range of approximately seventy percent (70%) to approximately eighty percent (80%) epoxy and within the range of approximately twenty percent (20%) to approximately thirty percent (30%) curing agent, blending strontium nitrate within the range of approximately forty weight percent (40%) to approximately sixty weight percent (60%) of the composition, and polyvinyl chloride within the range of approximately eleven weight percent (11%) to approximately sixteen weight percent (16%) of the composition, mixing the strontium nitrate and polyvinyl chloride mixture to the binder system coated magnesium mixture in a mixing bowl to provide the composition, and wiping the sides of the mixing bowl, screening the composition, aging the composition for a period of time, and pressing the composition into the flare composition.

2. The method of claim 1 wherein the wiping step includes wiping the sides of the mixing bowl with a non-sparking spatula.

3. The method of claim 1 wherein the screening step includes screening the composition through a Standard No. 16 sieve.

4. The method of claim 1 wherein the period of time is at least approximately three hours.

5. The method of claim 1 wherein the period of time is at least approximately eight hours.

6. The method of claim 1 wherein the step of pressing the composition includes a press consolidation pressure of at least approximately eight thousand (8,000 lbs) pounds dead load.

7. The method of claim 6 wherein the press consolidation pressure is at least approximately nine thousand (9,000 lbs) pounds dead load.

8. The method of claim 1, wherein the composition excludes perchlorate and calcium nitrate.

* * * * *